US005560612A

United States Patent [19]

Ippoliti et al.

[11] Patent Number: 5,560,612

[45] Date of Patent: Oct. 1, 1996

[54] NUMBER BOARD GAME APPARATUS

[75] Inventors: Camillo W. Ippoliti, deceased, late of Prospect Park; Mary Maira, executrix, Holmes, botoh of, Pa.

[73] Assignee: Dino Ippoliti

[21] Appl. No.: 512,882

[22] Filed: Aug. 9, 1995

[51] Int. Cl.[6] ..... A63F 3/00

[52] U.S. Cl. ..... 273/272

[58] Field of Search ..... 273/236, 264, 273/271, 272, 282.1, 283, 284, 260

[56] References Cited

U.S. PATENT DOCUMENTS

| | | | |
|---|---|---|---|
| 1,650,840 | 11/1927 | Katz | 273/272 |
| 3,267,590 | 8/1966 | Browning | 273/272 |
| 3,434,719 | 3/1969 | Fyanes | 273/260 |
| 3,545,101 | 12/1970 | Fike | 273/271 X |
| 4,213,616 | 7/1980 | Dickey | 273/271 |
| 4,565,374 | 1/1986 | Pak | 273/272 |
| 5,433,449 | 7/1995 | Sowek | 273/248 |
| 5,478,087 | 12/1995 | Dumisani | 273/272 |

*Primary Examiner*—William E. Stoll
*Attorney, Agent, or Firm*—Joseph W. Molasky & Associates

[57] ABSTRACT

A board game apparatus having a playing area divided by horizontal and vertical demarcations which form recessed spaces for receiving numbered blocks as they are transferred from strip spaces into which a limited and non-replenishable quantity of numbered blocks have been previously placed. The strip spaces are on the same game board as the playing area but in distinct strip areas. The numbered blocks are transferred to the playing area spaces to form a series of rows or columns in which the numbered blocks of each row or column add up to the same sum.

15 Claims, 2 Drawing Sheets

FIG. 3
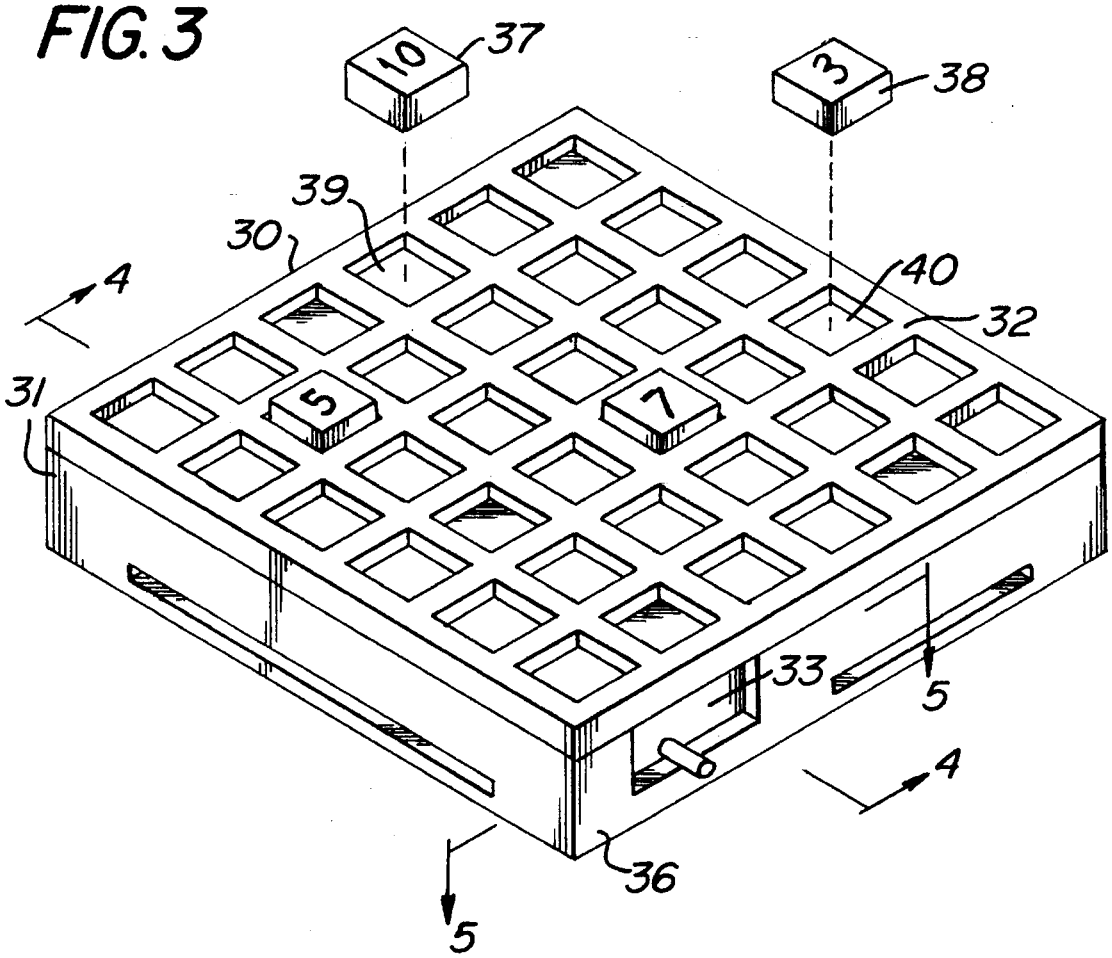
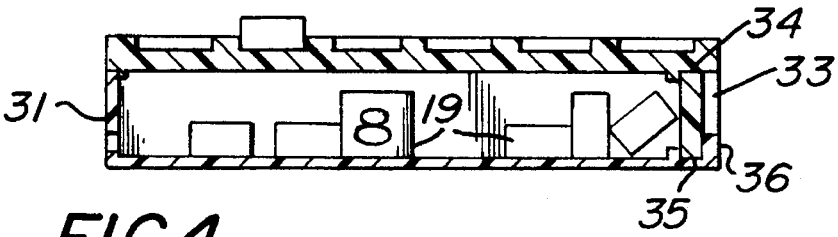
FIG. 4
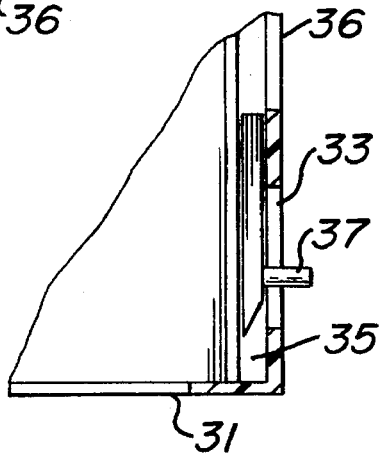
FIG. 5

NUMBER BOARD GAME APPARATUS

BACKGROUND OF THE INVENTION

The present invention relates to a game board and playing pieces for use thereon by a single player.

There are various "solitaire" type games in which a player seeks to dispose or play all of the playing pieces or cards. In such solitaire games, the player uses a supply of additional playing pieces or cards to facilitate in the playing and disposal of all the pieces.

Crossword-shaped puzzles on a grid-shaped board have been used for placement of letters in playing spaces to form words. Grid-shaped playing boards are typically adapted for receiving playing pieces from one or more players in a vertical or horizontal direction, e.g. a scrabble board. Players replenish playing pieces from a stock and seek to dispose of the playing pieces in accordance with a player's changing composition of playing pieces.

Conventional gird-shaped game boards serve as a repository for the pieces as they are played and not for holding pieces to be played during the course of the game. The game boards typically do not perform the functions of accommodating playing pieces, both before and after they are played. That is, conventional playing boards do not act as repositories for playing pieces prior to their transfer to another position on the board. Furthermore, typical grid-shaped game boards are designed to accommodate continually varying word patterns and are not designed for the repetition of a numerical summation in numerous different directions.

While the present invention is a type of solitaire game, it utilizes a fixed quantity of numbered playing pieces which are played on a crossword-type game board to form a pre-determined sum or total in every row or column. The present invention then uses number, rather than letters and requires a continually repeating pattern, that is, the predetermined sum. The game board accommodates playing pieces, both prior to and after they have been placed in the playing area. Accordingly, the game board does not act simply as a repository for the playing pieces. It should also be understood that the playing board accommodates a fixed number of playing pieces, which are not replenished as they are transferred into the playing area.

SUMMARY OF THE INVENTION

The game board apparatus comprises a game board divided by mutually perpendicular boundary demarcations. The boundary demarcations are slightly elevated above the game board surface and run in vertical and horizontal directions. The boundary demarcations form a shallow cavity in the shape of a square. These shallow square cavities hold square-shaped numbered blocks which are the playing pieces.

Horizontal strips of shallow square cavities, whose sides are formed by elevated side-demarcations, are placed on the game board at the top and bottom of the square or rectangular playing area. These cavities are formed in a similar fashion as the cavities on the playing board area and similarly hold the square numbered blocks. Vertical strips of the square shallow cavities for holding the square numbered blocks are also placed to the right and left of the playing area. It should be understood that while the horizontal and vertical strips are positioned on the game board, they are not contiguous with the playing area, but are spaced so that a distinct playing area and strip areas are formed.

The game board apparatus includes small numbered blocks as mentioned above, for placement in the various shallow cavities on the game board. The game board apparatus is used in accordance with the invention by first filling in the top strip space and vertical right-hand strip spaces on the game board with randomly chosen numbered playing blocks. The game can be played by filling from two to all four strips on the game board. The highest numbered block of each strip is removed from the strip and arranged in the playing area so that all 2, 3 or 4 blocks form a contiguous row or column. The numbered blocks can be arranged wherever desired within the playing area with the one limitation that no empty spaces can be present in the row or column formed from the highest numbered block of each strip.

The sum of the numbers designated on the numbered blocks forming the row or column in the playing area which is formed from the highest numbered block of each strip is determined. Then, the remaining numbered blocks in the strips are used to form new rows or columns in the playing area in which the numbers on the numbered blocks of each row or column add up to the pre-determined sum. That is the pre-determined sum is the sum of the numbers on the numbered blocks Which formed the initial row or column out of the highest numbered block of each strip. The new rows and columns are formed in a "crossword" style of rows or columns. Accordingly, all rows or columns formed in the playing area (except for the first row or column formed) use or incorporate one or more numbered blocks from a pre-existing row or column to form each new row or column in the playing area.

Thus, various combinations of numbered blocks from the strips will have to be considered with the numbered blocks already laid down in the playing area spaces. That is, the sum or total of various combinations of numbered blocks will have to be determined.

The player seeks to use all the numbered blocks from the strips by transferring the numbered blocks from the spaces in the strips to the appropriate spaces in the playing area. Upon the total transfer of all the numbered blocks from the strip spaces to the playing area spaces of the playing board, the player has successfully completed the game. If a player is not able to use all the numbered blocks, he adds the numerical value designated on the untransferred numbered blocks and is charged with the sum. Alternatively, the player can simply add the amount of blocks which remain untransferred.

The game can also be played with the use of a time piece to limit the time of play.

While the game is for use by a single player, two or more players can play simultaneously with the same predetermined numbered playing pieces or blocks in the strip spaces or with different numbered pieces in the strip spaces. A series of games can be played and scores compared with the low score winning.

Thus, it can be seen that the game involves the playing of a fixed number of playing pieces which are not replenished or augmented during the course of the game. This fixed number of playing pieces or numbered blocks are placed on the game board itself and transferred from the spaces on the strips to the desired spaces on the playing area. Furthermore, the desired arrangement of numbered blocks must be such that the numerical value designated on the numbered blocks of each row or column formed must invariably add to the same sum. This sum then occurs for every row and column throughout the entire playing area.

In accordance with the disclosure herein, it is an object of the present invention to provide a board game apparatus in which playing pieces to be played are positioned on the game board before their transfer to the playing position.

It is an object of the invention to provide a solitaire game to be played on a crossword-type game board in which the player attempts to use all the playing pieces by transferring them from a designated section of the game board to a playing area.

It is an object of the invention to provide a numbers game which involves summation of various numbered squares on a crossword-type game board.

It is a further object of the invention to provide a game board apparatus in which the numbered blocks forming each row or column add or total to the same number.

It is also an object of the invention to provide a game board apparatus which is designed to accommodate a predetermined fixed number of playing pieces, said playing pieces not being able to be replenished.

It is also an object of the invention to provide a game of skill, arithmetic calculation and some chance in which the playing time can be limited and in which the object is to transfer or play as many of the playing pieces as possible.

These and other objectives and features of the invention will become apparent from the following detailed description taken in conjunction with the accompanying drawings and appended claims.

BRIEF DESCRIPTION OF THE DRAWINGS

FIG. 3 is a perspective view of the game board equipped with a housing for holding playing pieces.

FIG. 4 is a side view of the game board shown in FIG. 3 along line 4—4.

FIG. 5 is a top view of a section of the game board shown in FIG. 3 along line 5—5.

DETAILED DESCRIPTION OF THE INVENTION

Figure 1:
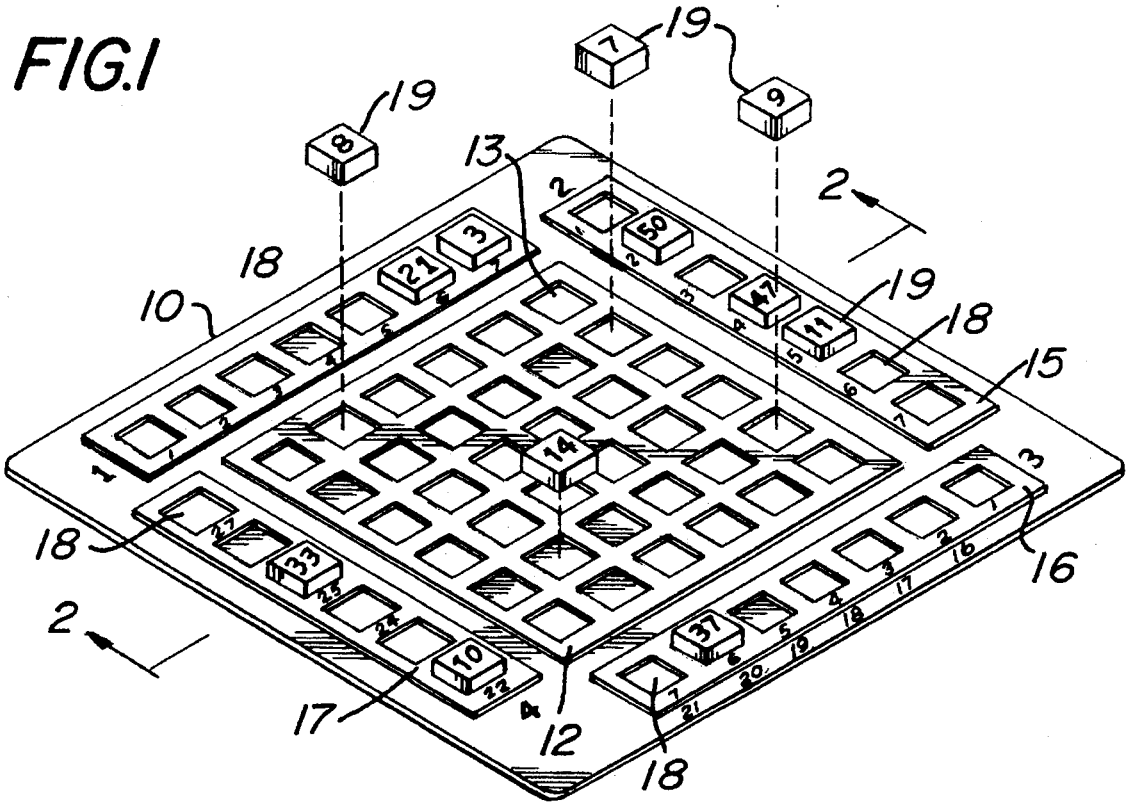
FIG. 1 is a perspective view of the game board.

Referring to FIG. 1, a perspective view of the game board 10 is shown. The game board includes a playing area 12 with elevated perpendicular horizontal and vertical boundary demarcations which form shallow recessed square-shaped spaces of which 13 is representative. A horizontal strip 14 is located at the top of the playing area with shallow recessed square spaces. Similarly, a vertical strip 15 is located to the right of the playing area, a second horizontal strip 16 to the bottom of the playing area and a second vertical strip 17 to the left of the playing area. All of strips 14, 15, 16, and 17 have recessed square strip spaces as typified by 18.

Whereas in the preferred embodiment of FIG. 1, the playing area is made up of seven vertical boundary demarcations and seven horizontal boundary demarcations which define 36 shallow recessed square spaces, the invention encompasses other greater or lesser numbers of vertical and horizontal demarcations defining either greater or lesser numbers of shallow recessed square spaces. Thus, the playing area need not be in the shape of a square, but can also be a rectangle.

Similarly, the preferred embodiment as shown in FIG. 1 discloses seven recessed strip spaces in the top, bottom and right-hand strips and six recessed strip spaces in the left-hand strip. The invention, however, also encompasses a game board whose strip spaces include a greater or lesser amount of strip spaces.

It should be noted that the top-horizontal strip is labelled number 1, the right-hand vertical strip is labelled number 2, the bottom horizontal strip is labelled number 3 and the left-hand vertical strip is labelled number 4.

The seven individual square-shaped spaces of strip number 1 are labelled left to right as numbers 1–7.

The seven individual square-shaped spaces of strip number 2 are labelled from top to bottom as numbers 1–7.

The seven individual square-shaped spaces of strip number 3 are labelled from right to left as numbers 1–7. The individual square-shaped spaces of strip number 3, starting with the strip space labelled number 2 are correspondingly doubly labelled as numbers 16–21.

The six individual square-shaped spaces of strip number 4 labelled from bottom to top as numbers 22–27.

It should be noted that as shown in FIG. 1, the horizontal and vertical strips 14, 15, 16 and 17 are positioned on the game board but are spaced away from the playing area to form distinct strip space areas.

Figure 2:
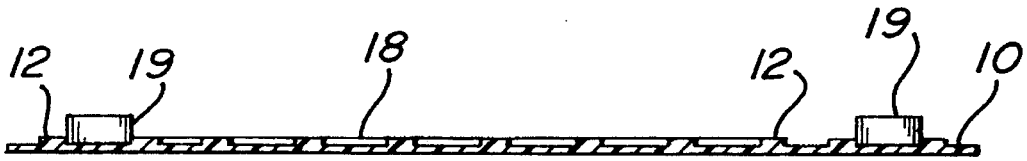
FIG. 2 is a side view of the game board shown in FIG. 1 along line 2—2.

Included in the board game apparatus are numbered blocks typical of which are the blocks identified as 19 in FIGS. 1 and 2. These numbered blocks are square-shaped and of a size to fit within the dimensions of the shallow recessed square spaces of the playing area and strips. In the preferred embodiment, there are 50 numbered blocks numbered 1–50 so that each block corresponds to a separate number. Other total numbers of blocks can be used whether they are of a greater or lesser quantity than 50.

The numbered blocks can be made of any suitable durable material which can be labeled with a number. Such materials include, but are not limited to wood, plastic, metal and other natural synthetic materials. The numbers can then be painted, printed, imprinted, embossed, carved or fixed in any manner to assure their permanency on the numbered block.

The game board 10 itself can be made out of any suitably durable rigid material which will lie flat on a surface such as a table or desk. Materials which may be used include, but are not limited to, metal, plastic, wood and other natural and synthetic materials. Such materials have to be able to form or mold to and retain the elevated vertical and horizontal boundary demarcations and the corresponding recessed square spaces.

The number board game apparatus is played by first placing all the numbered block pieces in a bag or by turning all the numbered block pieces over on a surface so their numbered markings are not visible. The blocks can also be stored in and dispensed from a rectangular-shaped housing 31 which is equipped with a playing surface 32 as shown in FIGS. 3, 4, and 5. The housing or chest 31 has a top, bottom, front, rear, and side walls, the right side wall (36) of which is equipped with a door 33 that slides back and forth within a track between open and closed positions to dispense blocks. The door functions by slidably engaging a top channel 34 and a bottom channel 35 on the inner surface of the front side wall 36. To dispense a block, a player opens the door 33 using the handle 37 and shakes loose the desired game piece or block.

Depending upon the number of strips the player has decided to fill, the player randomly chooses the requisite number of numbered blocks to fill the desired number of strips. For example, if two strips are to be filled, the player chooses 14 numbered blocks and places them in the strip spaces 18 of strips 1 and 2. If three strips are to be used, 21 numbered blocks are randomly chosen and placed in the strip spaces 18 of strips 1, 2 and 3. If four strips are to be used, the player chooses 27 numbered blocks and places them in the strip spaces 18 of strips 1, 2, 3 and 4. The numbered blocks are placed in the strip spaces 18 with the numbers indicated thereon facing upward, so they are visible to the player.

It should be understood that since the object of the game is to use as many of the numbered blocks in the strip spaces 18 as possible by transferring them to the recessed square spaces 13 of the playing area 12, the game is made more difficult as more strips are filled. Games using the first two strips are then the simplest and games using three or four strips are increasingly complex and difficult.

The highest numbered blocks from each strip filled are transferred to the spaces of the playing area. The highest numbered blocks are placed in spaces either horizontally or vertically contiguous to each other so that the blocks form a row or column of 2, 3 or 4 blocks, depending upon the number of strips previously filled. The highest numbered blocks can be placed in any of spaces 13 of the playing area 12 so long as they form a row or a column without any empty, unfilled spaces between the blocks.

The player adds up the numbers printed on the blocks which form this initial row or column formed from the highest numbered blocks of each strip. With this sum in mind, the player then attempts to place the remaining numbered blocks in the strip spaces 18 into the recessed square spaces 13 to form new rows or columns in which each new row or column formed is made up of numbered blocks whose sum equals this same sum of the initial row or column formed from the highest numbered blocks of each strip. The new rows or columns are to be formed by using one or more blocks of an already preexisting row or column. Each numbered block placed in the recessed space 13 must be next to a recessed space 13 which is filled with a numbered block. That is, the numbered block must be played in a space above, below or next to a recessed space already holding a numbered block. It cannot be only diagonal to a filled space. Thus, the new rows or columns are formed in a crossword-style fashion. However, the sum of the numerical value designated on the numbered blocks forming each row and column must equal the same sum.

The new rows and columns are formed by transferring numbered blocks from the spaces 18 of the strips 4, 5, 6 or 7 to the spaces 13 of the playing area 10. A player attempts to transfer all the numbered blocks from the strip spaces 18 to the recessed spaces 13 by placing them in rows or columns adding to the predetermined sum. When a player has transferred all the numbered blocks, he has successfully completed the game. If any numbered blocks are left untransferred, those blocks are assessed against the player by either adding the number value indicated on the blocks or by counting the number of blocks untransferred or some variation thereof.

The game can be played with a time limit imposed which is measured by a time piece. When a time limit is used, the player attempts to transfer as many or all of the numbered blocks to the playing area within the allotted time.

It should be understood that while the game is to be played by a single person, two or more players can play simultaneously on separate game board apparatuses. In such situations, players can use blocks with the same numbered values indicated thereon. The player transfers all or most of the numbered blocks from the strip spaces 18 to the playing area in either a specified or unspecified time becomes the winner. Alternatively, players can each pick their own numbered blocks for placement into the strip spaces and play simultaneously with their own chosen numbered blocks. If no player successfully transfers all the numbered blocks into the playing areas, the players can decide to either assess each player a penalty equal to the sum of the numbers on the untransferred blocks or they may simply count the number of untransferred blocks.

In a variation of the foregoing, the player or players select their numbered block but instead of placing them into strip spaces 18 of game board 10, an alternate game board such as board 30 (FIG. 3) is used and the blocks are simply held or displayed in a convenient location. Then, as described above, the player or players transfer the blocks to the game board 30. See, in this regard, FIG. 3 where blocks 37 and 38 are shown as typical game pieces which are positioned for placement in spaces 39 and 40.

It should be understood that while several preferred embodiments have been described, this invention is capable of further modification and the subject matter sought to be patented consists essentially of a game board apparatus with different numbers of strips, strip spaces, playing area spaces and numbered blocks. It has been found, however, that the use of approximately 14 to 27 numbered blocks in a playing area of approximately 36 spaces arranged in a vertical/horizontal crossword arrangement presents a game of challenging mental complexity in which the multitude of possible arrangements of rows or columns made up of the numbered blocks can be quickly tested. The game board allows for easy comparison and experimentation with possible rows or columns because of the close proximity of the strip spaces and playing spaces on the game board. The shallow spaces which hold the numbered blocks in their designated positions facilitate keeping the transferred and untransferred numbered blocks segregated. This allows for a quick assessment of transferred and untransferred number blocks and helps organize contemplation of various combinations of numbered blocks for the purpose of forming rows and columns in the playing area.

Although the present invention has been described with reference to the particular embodiments herein set forth, it is to be understood that the present disclosure has been made by only way of example and that numerous changes in the details of the discussion may be resorted to without departing from the spirit and scope of the invention.

What is claimed is:

1. A board game apparatus comprising:

a game board having a playing area divided by mutually perpendicular and elevated vertical and horizontal boundary demarcations so that square-shaped shallow recessed spaces are formed, said spaces adapted to receive numbered blocks and limit movement of the numbered blocks along the game board, said board having a horizontal strip at the top of the playing area, a horizontal strip at the bottom of the playing area, a vertical strip to the right of the playing area and a vertical strip to the left of the playing area, said strips having square-shaped shallow recessed spaces adapted to receive numbered blocks and limit the movement of the numbered blocks along the game board; and a multiplicity of numbered blocks for placement in the recessed spaces of the playing area and strips, so that a finite quantity of numbered blocks can be transferred from the strip spaces to the playing area spaces to form rows and columns in which the numbers of the numbered blocks of each row and column add to the same number.

2. The board game apparatus of claim 1 wherein the playing area forms a square having six horizontal rows and six vertical columns.

3. The board game apparatus of claim 1 wherein the top and bottom horizontal strips and right vertical strip have seven spaces and the left vertical strip has six spaces.

4. The board game apparatus of claim 1 wherein the strips are spaced away from the playing area in a non-contiguous relationship to the playing area.

5. The board game apparatus of claim 1 wherein a finite quantity of numbered blocks are chosen for placement in the strip spaces.

6. The board game apparatus of claim 5 wherein the finite quantity of numbered blocks chosen for placement in the strip spaces are chosen from about 50 numbered blocks.

7. The board game apparatus of claim 1 wherein the first row or column of numbered blocks in the playing area is formed by the transfer of the highest numbered block from each strip to the playing area spaces.

8. The board game apparatus of claim 1 wherein the numbered blocks are transferred from the strip spaces of two strips holding numbered blocks to playing area spaces adjacent to a playing area space holding a numbered block.

9. The board game apparatus of claim 1 wherein the numbered blocks are transferred from the strip spaces of three strips holding numbered blocks to the playing area spaces adjacent to a playing area space holding a numbered block.

10. The board game apparatus of claim 1 wherein the numbered blocks are transferred from the strip spaces of four strips holding numbered blocks to the playing area spaces adjacent to a playing area space holding a numbered block.

11. The board game apparatus of claim 1 for use by a single player.

12. A board game apparatus comprising:

a game board having a playing area divided by mutually perpendicular and elevated vertical and horizontal boundary demarcations so that square-shaped shallow recessed spaces are formed, said spaces adapted to receive numbered blocks and limit movement of the numbered blocks along the game board, said board including a housing in which said blocks are stored and means for dispensing one or more of said blocks.

13. The board game apparatus of claim 12 wherein said dispensing means consists essentially of a door that slides back and forth within a track from an open position to a closed position.

14. A method for playing a numbered game board apparatus:

having a playing area divided by mutually perpendicular and elevated vertical and horizontal boundary demarcations so that square-shaped shallow recessed spaces are formed, said spaces adapted to receive numbered blocks and limit movement of the numbered blocks along the game board, said board having a horizontal strip at the top of the playing area, a horizontal strip at the bottom of the playing area, a vertical strip to the right of the playing area and a vertical strip to the left of the playing area, said strips having square-shaped shallow recessed spaces adapted to receive numbered blocks and limit the movement of the numbered blocks along the game board and numbered blocks; and said method comprising:

a) placing said numbered block pieces in a receptacle so that the numbered markings are not visible;

b) randomly selecting a desired number of said blocks from said receptacle;

c) placing said blocks on said spaces of said strip; and d) transferring a finite quantity of numbered blocks from said strip spaces to the playing area space to form rows and columns in which the numbers of the numbered blocks of each row and column add to the same number.

15. The method of claim 14 wherein a time limit is imposed on step (d).

* * * * *